US006000554A

United States Patent [19]

Hughes

[11] Patent Number: 6,000,554

[45] Date of Patent: Dec. 14, 1999

[54] RECIPROCATING SCREENING CONVEYOR

[75] Inventor: John H. Hughes, Montesano, Wash.

[73] Assignee: ComCorp, Inc., Montesano, Wash.

[21] Appl. No.: 08/645,455

[22] Filed: May 13, 1996

[51] Int. Cl.[6] ..... B07B 1/28

[52] U.S. Cl. ..... 209/314; 209/680; 209/311; 209/365.2; 209/421; 209/920

[58] Field of Search ..... 209/680, 314, 209/341, 311, 322, 365.2, 397, 421, 920

[56] References Cited

U.S. PATENT DOCUMENTS

| | | | |
|---|---|---|---|
| 1,136,293 | 4/1915 | Sutton et al. | 209/314 |
| 1,610,716 | 12/1926 | Stebbins | 209/920 |
| 2,329,333 | 9/1943 | Carter | 209/314 |
| 3,543,928 | 12/1970 | Green . | |
| 3,944,077 | 3/1976 | Green . | |
| 4,366,928 | 1/1983 | Hughes . | |
| 4,664,790 | 5/1987 | Lundqvist . | |
| 4,789,068 | 12/1988 | Gilmore . | |
| 5,000,390 | 3/1991 | Marrs . | |
| 5,051,170 | 9/1991 | Ahorner | 209/341 |
| 5,074,992 | 12/1991 | Clinton . | |
| 5,078,274 | 1/1992 | Brown . | |
| 5,085,324 | 2/1992 | Dehlén | 209/314 |
| 5,137,621 | 8/1992 | Brown . | |
| 5,292,006 | 3/1994 | Girts, Jr. . | |
| 5,379,951 | 1/1995 | Hughes . | |
| 5,417,858 | 5/1995 | Derrick et al. | 209/397 |
| 5,577,618 | 11/1996 | Rafferty | 209/421 |
| 5,586,661 | 12/1996 | Maki | 209/397 |

FOREIGN PATENT DOCUMENTS

| | | | |
|---|---|---|---|
| 1488026 | 6/1989 | U.S.S.R. | 209/311 |
| 24032 | of 1910 | United Kingdom | 209/397 |

OTHER PUBLICATIONS

Product brochure for Taper Slot™ Vibratory Screens; Action Equipment Company, Inc., believed to be published prior to May 13, 1996.

*Primary Examiner*—David A. Bucci
*Assistant Examiner*—Douglas Hess
*Attorney, Agent, or Firm*—Christensen O'Connor Johnson & Kindess PLLC

[57] ABSTRACT

A screening conveyor (10) for conveying particulate matter, such as comminuted wood fiber, in a forward direction while also screening to separate particles over a predetermined size from small particles under a predetermined size. The screening conveyor includes a frame (17, 50) and first and second conveyor bed sections (16, 30) supported by the frame. Each conveyor bed section defines a longitudinal axis and an upper surface (22) formed from a tiled series of trough shaped trays (20). Each tray defines a step including an ascending surface portion (96). The first and second conveyor bed sections are reciprocated in opposing balanced fashion along the longitudinal axis by a motor (48), cam assembly (54) and connecting rods (64, 66). The received particulate matter is carried on the stepped upper surfaces of the reciprocating conveyor bed and thrown forwardly from tray to tray. The upper surfaces further each define a plurality of apertures of predetermined size. Particulate matter is screened through first screening apertures (34) in the first conveyor bed section, with material below a predetermined size falling onto the second conveyor bed section. Material over the first predetermined size is supplied to a recycle conveyor (38) for further comminuting. Material passing through the first screening apertures falls onto the second conveyor bed section, and is further screened through second screening apertures (42) of a second predetermined size. Fine particles pass through the second screening apertures, and acceptable product is discharged from the discharge end (32) of the second conveyor bed section.

44 Claims, 6 Drawing Sheets

RECIPROCATING SCREENING CONVEYOR

FIELD OF THE INVENTION

The present invention relates to the conveying of solid materials and to dimensional screening of solid particulate matter, and more particularly to the conveying and screening of chipped wood products.

BACKGROUND OF THE INVENTION

There are many industrial applications where it is necessary to convey small objects or particles from a first elevation to a second, higher elevation. There are also many processes that require particulate matter to be dimensionally screened to sort the matter into different size classifications. Both of these processes are entailed in the refining or comminuting (i.e., grinding) of waste wood such as stumps, mill waste and salvaged wood scraps to the particulate or chip form. The wood matter is ground within a comminuter producing large particles or chips of fibrous wood and bark. Typically this material is discharged by gravity or an impeller from the comminuter, and contains a variety of particle sizes which are suited for different purposes. Often for any given quantity of a particular desired size product ("acceptable product") there is also a quantity of smaller particles and entrained dirt and sand ("fines"), as well as over-sized particles that may need additional comminuting ("overs"). It is necessary to screen the comminuted product to separate the acceptable product from the fines and overs. Each product must then be elevated for loading into a truck or container for shipment, or for further processing.

Conventional comminuters may be used in conjunction with bucket loaders or belt conveyors to elevate the product. Belt conveyors are satisfactory for elevating product, but they do not serve to screen the product. Vibratory conveyors may also be utilized, but they are limited in their application as they will only convey material up a very limited incline. Whatever conventional conveyor is employed, a separate screening device must also be utilized. Typical screening devices include vibratory screeners which shake the product on top of a screen having a number of perforations that retain product of one size while allowing product of another size to fall through the perforations. These products tend to be constructed from durable metals, primarily steel, which is very heavy, making transport difficult. Such screening devices also entail the product flowing downwardly through the device, requiring re-elevation of the product for subsequent loading and handling.

Conventional screening and conveying of comminuted wood product thus necessarily entails the use of separate screening and conveying components. This results both in a time consuming, multi-step post-comminuting process, as well as the expense of procuring and maintaining separate screening and conveying equipment. The overall space required to operate both conveyors and screeners, and for loading and unloading of these devices, is also considerable.

SUMMARY OF THE INVENTION

The present invention provides a screening conveyor for conveying particulate matter in a forward direction while screening the particulate matter to separate large particles that are over a predetermined size from small particles that are under a predetermined size. As used herein, the term "particulate matter" is meant both to encompass irregularly-shaped particles and chunks of material, including comminuted wood fiber, as well as other small objects which require conveying and/or screening, such as agricultural products, mineral products, and small plastic or metallic objects. The screening conveyor includes a frame and a conveyor bed supported above the frame. The conveyor bed defines a longitudinal axis and an upper surface for receiving particulate matter. The upper surface of the conveyor bed defines a series of steps, each step including an ascending surface portion.

The screening conveyor further includes a motor mounted on the frame and a connecting rod and eccentric cam coupling the conveyor bed to the motor for reciprocating the conveyor bed along its longitudinal axis. As the conveyor bed is reciprocated back and forth along its longitudinal axis, particulate matter is carried on the ascending surface portions and thrown forwardly from step to step. Thus, materials are conveyed from a receiving end of the conveyor to a discharge end, which may be at an elevated location.

The screening conveyor further includes a screen defining a plurality of openings of predetermined size which is carried on the conveyor bed so that particulate matter is screened through the openings as it is conveyed on the conveyor bed. In a preferred embodiment, the screen is defined by a plurality of openings defined in the floor of the conveyor bed, so that the particulate matter passes over the openings as it is conveyed during reciprocation of the conveyor bed, allowing small particles to fall free of the conveyor bed while large particles are carried further forwardly on the conveyor bed.

In a still further aspect of the present invention, the reciprocating screening conveyor includes first and second conveyor bed sections, which are oriented in overlapped parallel disposition. The conveyor sections are balanced and connected by corresponding connecting rods and eccentric cams to a common motor drive shaft. The conveyor bed sections reciprocate in opposing fashion, with particulate matter being conveyed along the first conveyor section, and screened through apertures of a first predetermined dimension provided in the first conveyor section. The smaller matter that falls through the first conveyor section lands on the second conveyor section for further conveyance and screening through apertures of a second predetermined dimension.

The present invention thus provides for efficient concurrent screening and conveyance of particulate matter upwardly along an incline. The throwing action afforded by the reciprocation of the conveyor beds aids both in conveying material from step to step and in the screening of the material through the screening apertures. By using reciprocating first and second conveyor sections, material can be screened at the same time that it is elevated. In a preferred embodiment, the conveyor bed is formed from a plastic material which is corrosion resistant, and which is lightweight for transport.

The throwing or ratcheting action of the conveyor bed for moving material up an incline incrementally from step to step provides several advantages. The agitation of the material on the reciprocating conveyor bed assists the material in passing through the screen apertures for more complete screening. Additionally, the agitation and impact of the material on the ascending surfaces of the conveyor steps aids in breaking up clumps of material and in causing the materials to separate by size and density. Thus when conveying comminuted wood, larger chunks of fibrous material tend to rise above smaller particles, facilitating passage of the smaller particles to the screening apertures. As a further example, use of the conveyor for screening and conveying agricultural products, such as ground flax, results in good separation of plant fibers from chaff.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
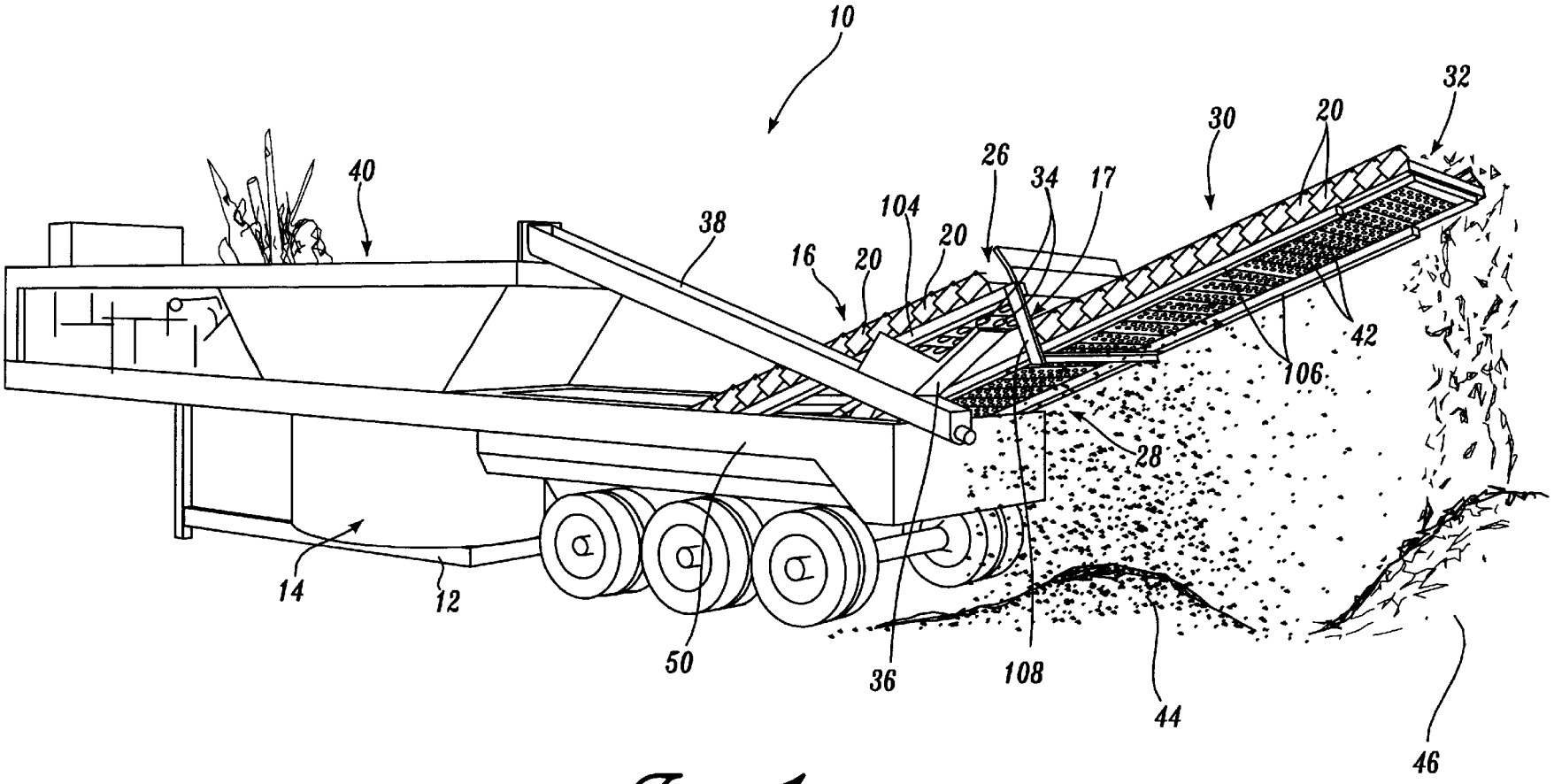
FIG. 1 provides a perspective view of a screening conveyor constructed in accordance with the present invention mounted on a transport trailer.
Figure 2:
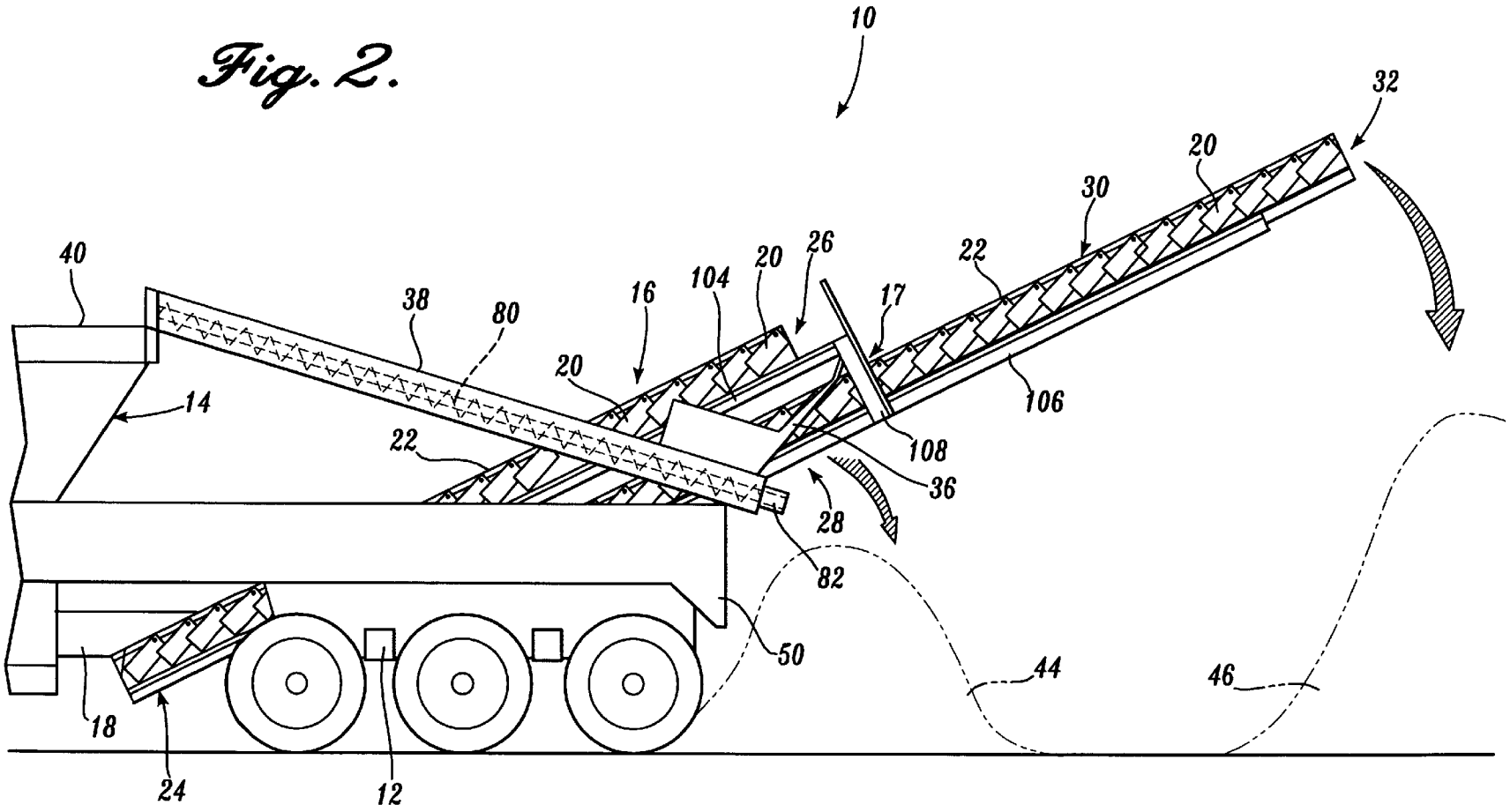
FIG. 2 provides a side elevation view of the screening conveyor of FIG. 1.

A screening conveyor 10 constructed in accordance with the present invention is illustrated in FIGS. 1 and 2. The screening conveyor 10 is mounted on a portable transport trailer 12 which also carries a comminuter 14. The comminuter 14 is used for refining waste wood into particulate matter or chips, and may be of any conventional construction. One suitable comminuter is disclosed in U.S. Pat. No. 5,379,951 to Hughes. The screening conveyor 10 includes a first conveyor bed section 16 which receives comminuted wood product from an outlet 18 of the comminuter 14. The first conveyor bed section 16 reciprocates forward and backward along its inclined longitudinal axis within a frame rail assembly 17. The first conveyor bed section 16 is formed from a tiled series of overlapped, trough-shaped trays 20. The trays 20 cooperatively define a ratchet-like, sawtoothed contoured upper surface 22 of the first conveyor bed section 16. Each tray 20 defines a transverse step, the step being thus formed sequentially along the length of the upper surface 22. As the first conveyor bed section 16 reciprocates, an ascending surface of each step, defined at the overlapped intersection of each pair of adjacent trays 20, carries the comminuted wood particles forwardly and upwardly along the incline of the conveyor bed, reciprocating with sufficient force to throw the particles forward from tray 20 to tray 20.

The first conveyor bed section 16 has a lower feed end 24 positioned adjacent to the outlet 18 of the comminuter 14, and an upper discharge end 26. The discharge end 26 of the first conveyor bed 16 overlaps the feed end 28 of a second conveyor bed section 30. The second conveyor bed section 30 is constructed substantially the same as the first conveyor bed section 16, being formed from a plurality of tiled trays 20 and defining a stepped upper surface 22. The second conveyor bed section 30 is oriented below and parallel to the first conveyor bed section 16, projecting upwardly and forwardly past the first conveyor bed section 16, to terminate in an upper discharge end 32. The second conveyor bed section 30 also reciprocates forward and backward along its longitudinal axis. As used herein throughout, the term "forward" refers to the direction away from the comminuter 14, while the term "backward" refers to the direction toward the comminuter 14. The second conveyor bed section 30 reciprocates in opposing, balanced fashion relative to the first conveyor bed section 16. Thus, the second conveyor bed section 30 moves diagonally backward as the first conveyor bed section 16 moves diagonally forward, and vice versa.

As can be seen in FIG. 1, an upper portion of the trays 20 of the first conveyor bed section 16 includes a plurality of first screening apertures 34, which have a predetermined first size to allow particulates having a diameter equal or less than that of the largest acceptable product to pass through the apertures 34. As the comminuted wood product is conveyed upwardly along the reciprocating first conveyor bed section 16, and approaches the discharge end 26 of the first conveyor bed section 16, it is thrown on top of and agitated over the first screening apertures 34. Acceptable product and smaller particles fall through the first screening apertures 34 onto the feed end 28 of the second conveyor bed section 30. Particles which are too large to pass through the first screening apertures 34 are discharged off of the forward tip of the discharge end 26 of the first conveyor bed section 16, falling onto a collector tray 36. The collector tray 36 slopes slightly downwardly to feed these oversized particles into the feed end of an auxiliary recycle conveyor 38. In the embodiment illustrated, the recycle conveyor 38 is a conventional auger conveyor, which rotates to convey the oversized particles upwardly and rearwardly into the inlet 40 of the comminuter 14. The oversized particles are thus recycled for re-comminuting.

The remaining particles which are within or smaller than a predetermined acceptable size range fall through the first screening apertures 34 onto the feed end 28 of the second conveyor bed section 30. As the second conveyor bed section 30 longitudinally reciprocates, this particulate matter is carried and thrown, i.e., propelled, upwardly from tray to tray 20. The trays 20 in the second conveyor bed section 30 are each provided with a plurality of second screening apertures 42, which have a second predetermined diameter corresponding to the minimum acceptable diameter for the desired wood product. Wood particles which are smaller than this minimum size, as well as smaller contaminants such as dirt and sand, fall downwardly through the second screening apertures 42 of the second conveyor bed section 30, forming a pile 44 of "fines". The desired product, which has a diameter less than that of the first screening apertures 34 but greater than that of the second screening apertures 42, continues up the length of the second conveyor bed section 30, and is discharged off of the upper tip of the discharge end 32. This acceptable product is preferably loaded directly into a truck or container for transport, or falls into a pile 46 of acceptable product as illustrated in FIGS. 1 and 2.

Figure 3:
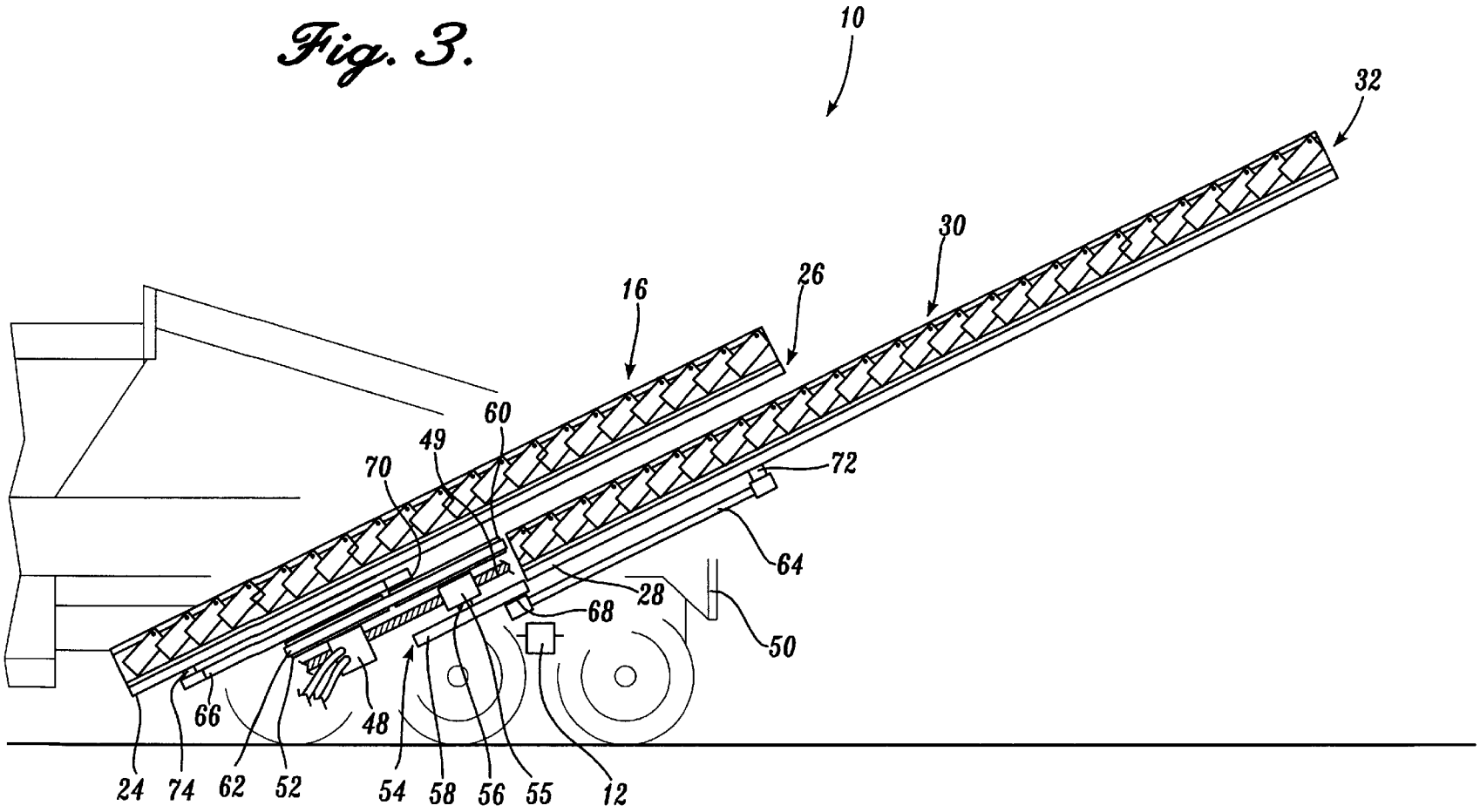
FIG. 3 provides a side elevation view of the screening conveyor of FIG. 1, with the stationary frame broken away to illustrate the positioning of the conveyor bed sections and drive connecting rod assembly.

Referring now to FIG. 3, the first and second conveyer bed sections 16 and 30 are reciprocated by a hydraulic motor 48 mounted on a plate 49 welded within the structure of a frame 50 which supports the conveyor, which in turn is secured to the trailer 12. A drive pulley 52 is mounted on the driveshaft of the motor 48. A cam assembly 54 is mounted upwardly of the drive pulley 52. The cam assembly 54 includes a bearing shaft 56 which is journaled within a bearing 55 mounted within an aperture formed in the frame plate 49. Cylindrical lower and upper cam plates 58 and 60 are axially secured on either end of the bearing shaft 56. A belt 62 is trained about the drive pulley 52 and the upper cam plate 60. The motor 48 thus drives rotation of the entire cam assembly via the drive pulley 52 and belt 62. It should be apparent to those of ordinary skill in the art that, space permitting, the cam assembly 54 could alternately be mounted axially directly on the driveshaft of the motor.

Figure 4:
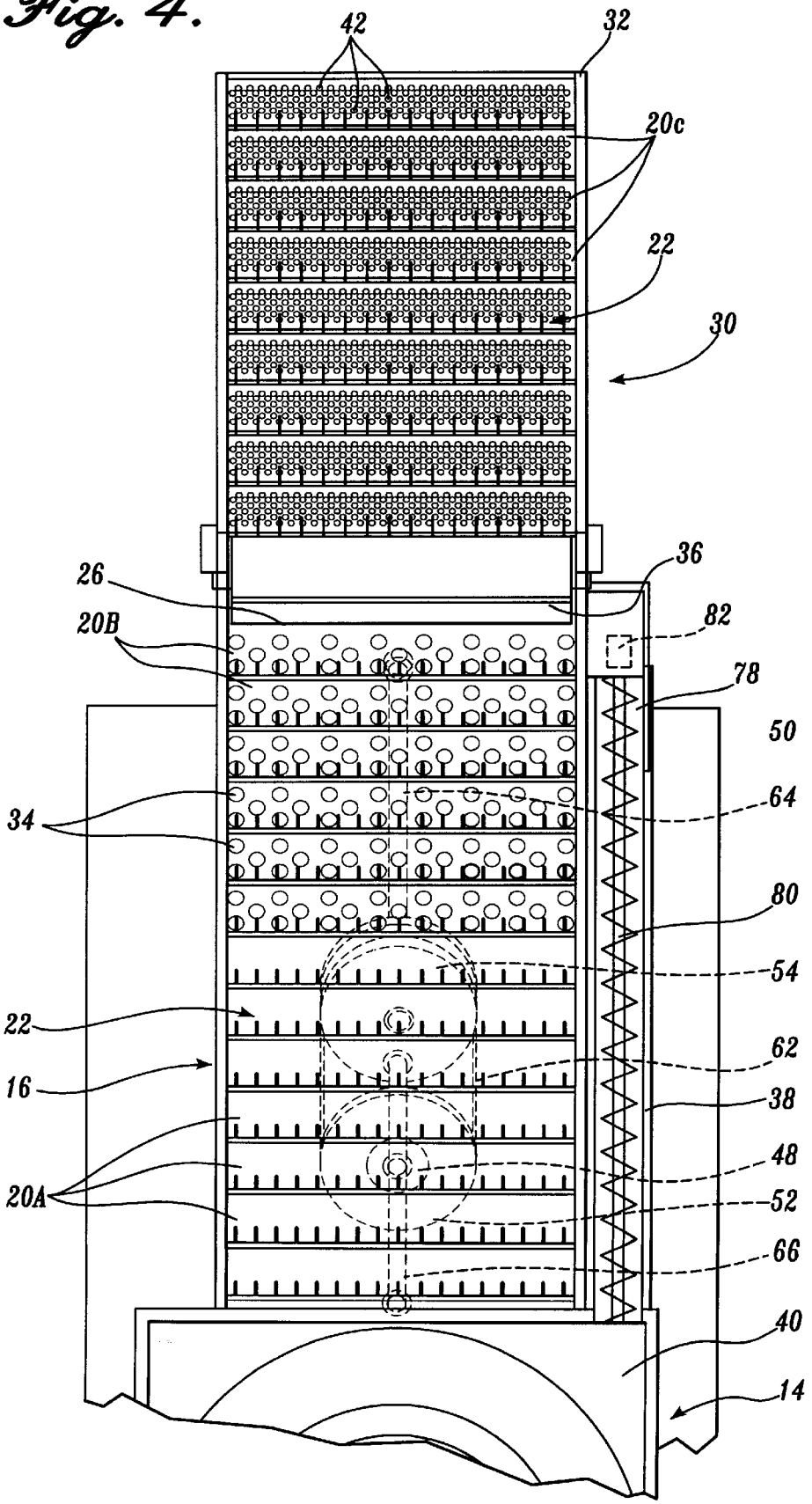
FIG. 4 provides a top plan view of the conveyor bed sections and recycle auger of the screening conveyor of FIG. 1.

Each cylindrical cam plate 58 and 60 acts as an eccentric cam. Connecting rods 64, 66 are coupled between the cam plates 58, 60 and the conveyor bed sections 30, 16, respectively. As can be seen in FIG. 4, a drive end of each connecting rod 64, 66 is journaled on a stub shaft 68, 70 protruding from each corresponding cam plate 58, 60. The stub shafts 68 and 70 are each mounted radially offset from the bearing shaft 56, so that each stub shaft 68 and 70 traces a circular path about the bearing shaft 56 during rotation of the cam assembly 54. The stub shafts 68 and 70 are offset from each other by 180°. The opposite, follower end of each connecting rod 64, 66 is provided with a wrist pin 72 and 74. Each wrist pin 72, 74 is journaled within a transverse mounting plate 88 (FIG. 6) of the corresponding second conveyor bed section 30 or first conveyor bed section 16, respectively.

The connecting rods 64 and 66 are thus pivotably coupled between the cam assembly 54 and the second conveyor bed section 30 and first conveyor bed section 16, respectively. The connecting rods 64, 66 translate rotary motion of the cam assembly 54 into longitudinal motion of the conveyor bed sections 30, 16. As the cam assembly 54 rotates, each of the conveyor bed sections 16 and 30 is caused to move longitudinally forward and backward along the incline of the conveyor 10, in reciprocating fashion. Because the first and second conveyor bed sections 16 and 30 move in opposing fashion, traveling away from and then toward each other, movement of the conveyor bed sections is balanced. By constructing the first and second conveyor bed sections 16 and 30 to have equal weight, this balanced motion causes the overall machine to operate very smoothly despite the rapid and forceful reciprocation of the conveyor bed sections, which for comminuted wood product suitably occurs at a speed of 100–120 revolutions per minute (i.e., 100–120 forward and backward reciprocations per minute). The speed of reciprocation can be adjusted by adjusting the operation of the hydraulic motor 48.

The first and second conveyor bed sections 16 and 30 are capable of elevating particulate matter along an incline. For comminuted wood product, it has been found that elevation along an incline of less than or equal to approximately 34 degrees (i.e., a rise over run of ⅔) is suitable, and preferably an incline of approximately 26 degrees (a rise over run of ½) is employed. However, it should be apparent that the conveyor could also be suitably employed for lesser degrees of elevation, or even horizontal operation, and could also be adapted through reconfiguring of the angling of the steps formed by the trays 20 for somewhat greater degrees of inclination.

In the embodiment illustrated, the cam assembly 54 and connecting rods 64, 66 are designed to provide an 18 inch throw, i.e., longitudinal travel during reciprocation, for each of the conveyor bed sections 16 and 30, although this could be adapted for greater or lesser throws in accordance with the disclosure contained herein. Each tray 20 of the first and second conveyor bed sections 16 and 30 provides a length (i.e., measured along the longitudinal axis of the conveyor bed section) of twelve inches, and a width of 45 inches. The first conveyor bed section 16 suitably contains twenty trays, for an overall length of twenty feet, while the second conveyor bed section 30 suitably includes twenty-three trays 20, for an overall length of twenty-three feet. Again, the number and dimension of trays is provided solely by way of example, and is not intended to be limiting. The dimension and number of trays may be readily modified for particular applications in accordance with the disclosure contained herein. A screening conveyor 10 constructed in accordance with these exemplary dimensions, is able to convey and screen approximately twenty tons per hour of desired product and an additional five tons per hour of fine particles.

Attention is now directed to FIG. 4 to better understand the screening features of the screening conveyor 10. As noted previously, in the illustrated embodiment, the first conveyor bed section 16 includes twenty trays 20. The lowermost fourteen trays 20*a* are not provided with any screening apertures. The particulate matter is thus conveyed, by reciprocal throwing, up these trays 20*a* without any screening of the product. However, the agitation of the product as it is conveyed from tray 20 to tray 20, as well as the impact of the material on each tray, serves to separate clumps of the particulate matter, and causes the larger particles to "float" on top of the smaller particles. The last six trays 20*b* of the first conveyor bed section 16 are each provided with a plurality of first screening apertures 34 arranged in a pattern across the width and length of the tray 20. For screening and conveying comminuted wood product, a suitable dimension for each first screening aperture 34 is a diameter of three inches. As the particulate matter is conveyed onto these uppermost trays 20*b*, acceptable product and fines, i.e., product having a diameter less than the predetermined diameter of the first screening apertures 34, falls through the apertures and onto the underlying feed end 28 of the second conveyor bed section 30.

The remaining oversized particles continue upwardly along the uppermost trays 20*b*, until they are thrown off of the uppermost tip of the discharge end 26 of the first conveyor bed section 16. These oversized particles are received on the collector tray 36, which runs transversely below the tip of the discharge end 26 of the first conveyor bed section 16. The collector tray 36 slopes slightly downwardly and funnels the received particulate matter into the lowermost, feed end 78 of the recycle conveyor 38. The internal screw 80 of the conveyor 38 is caused to rotate by means of a motor 82 mounted on the feed end 78 of the recycle conveyor 38. This causes the oversized particles to travel upwardly along the length of the recycle conveyor 38 until they are discharged into the inlet 40 of the comminuter 14.

Each of the trays 20*c* of the second conveyor bed section 30 is provided with a plurality of second screening apertures 42 arranged in a pattern across the width and length of the tray 20*c*. The particulate matter which is passed through the first screening apertures 34 of the first conveyor bed section 16 is now conveyed up the length of the second conveyor bed section 30. As the material is thrown from tray 20*c* to tray 20*c*, it impacts and is agitated over the top of the second screening apertures 42. Particles which are smaller than the predetermined dimension of the second screening apertures 42, as well as small contaminants, pass through the apertures 42. For comminuted wood product, a suitable dimension for the second screening apertures 42 is ¾ inch in diameter. Again, these dimensions are provided by way of example only and are not intended to limit the scope of the present invention, as other dimensions may be utilized.

Figure 5:
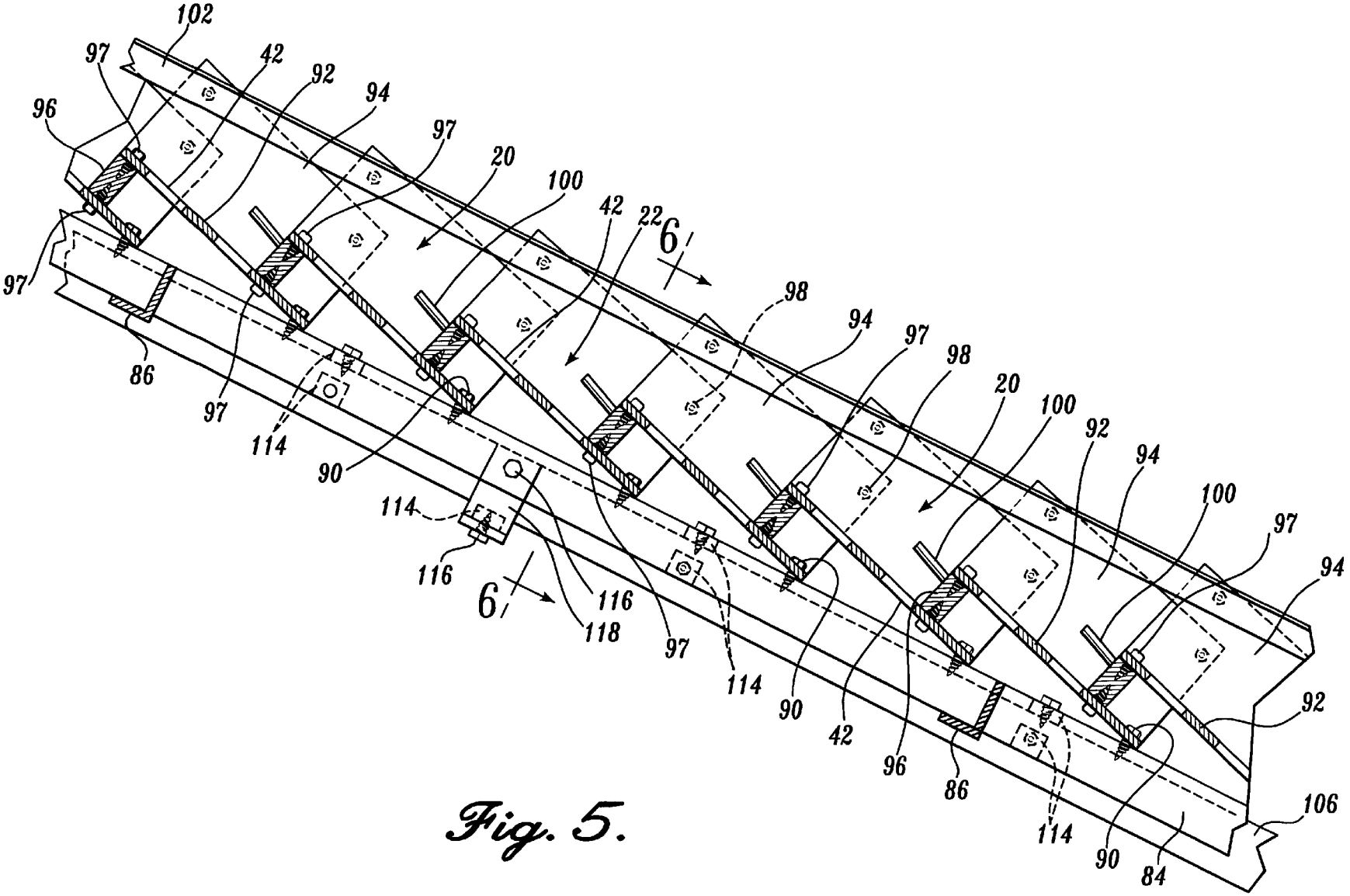
FIG. 5 provides a longitudinal cross sectional view of a portion of a conveyor bed section of the conveyor of FIG. 1.
Figure 6:
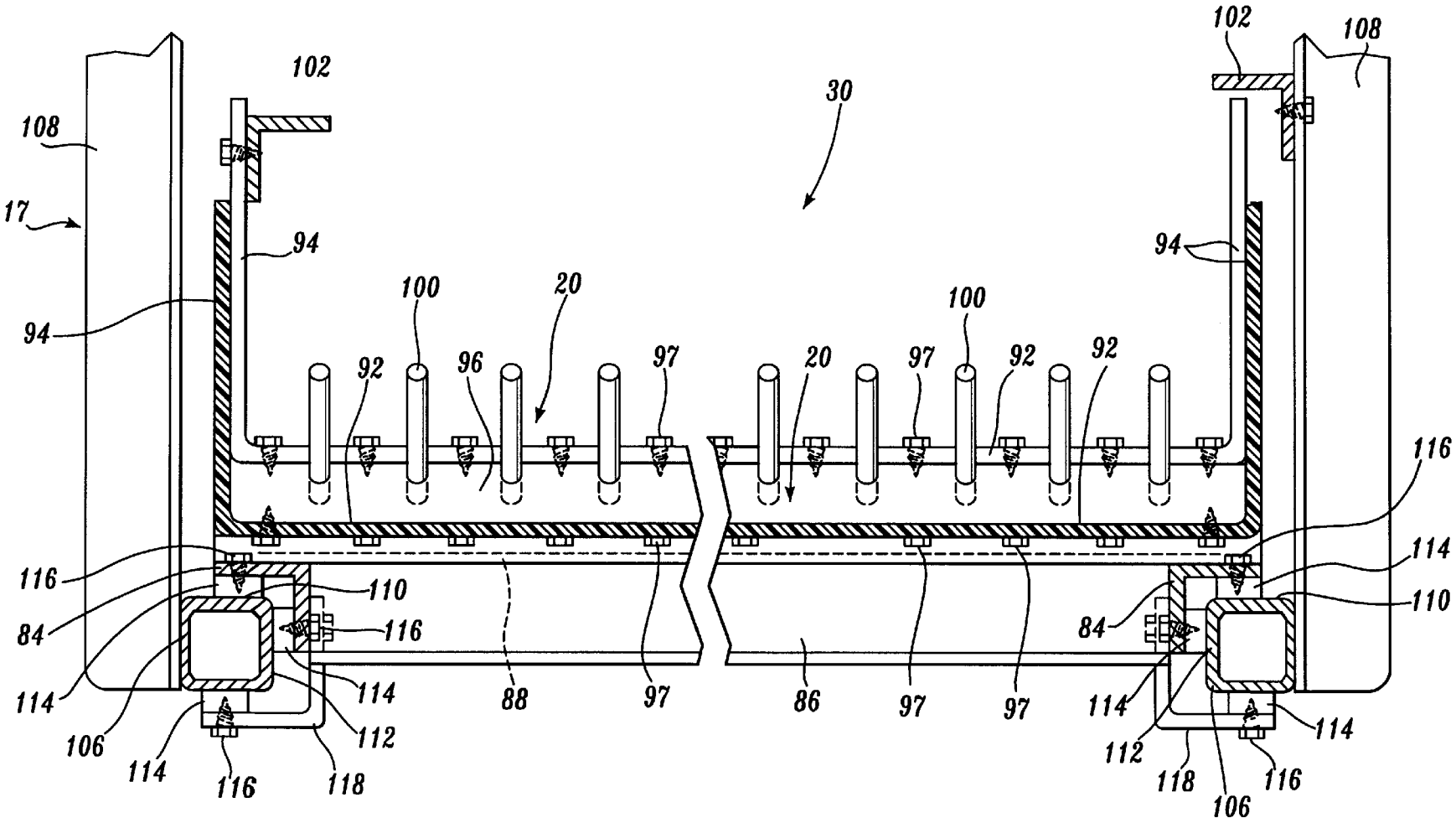
FIG. 6 provides a transverse cross-sectional view of the end of a conveyor bed section and supporting frame of the conveyor of FIG. 1, taken substantially along line 6—6 of FIG. 5.

Attention is now directed to FIGS. 5 and 6 to explain the construction of the first and second conveyor bed sections 16 and 30. Each of these conveyor bed sections is identically constructed, except for length and placement and size of the screening apertures. Thus only the second conveyor bed section 30 is illustrated and described. However, it should be understood that the first conveyor bed section 16 is similarly constructed. The second conveyor bed section 30 includes first and second longitudinal lower conveyor rails 84. Each of these rails is formed from a length of 90 degree steel angle, and runs the length of the second conveyor bed section 30. The lower conveyor rails 84 are oriented and spaced in parallel disposition along either side of the bottom of the second conveyor section 30. Several crossmembers 86, each also formed from a length of 90 degree steel angle, are welded transversely between the lower conveyor rails 84. The crossmembers 86 are oriented at intervals along the length of the lower rails 84, forming a ladder-like supporting framework. A wrist pin mounting plate 88 is also secured across the upper surface of the lower conveyor rails 84, spanning the width of the second conveyor bed section 30 at a point slightly upward from the feed end 28. The plate 88 carries a bearing which receives the stub shaft 72 of the connecting rod 64 to drive reciprocation of the second conveyor bed section 30, and also further strengthens the framework of the second conveyor bed section 30.

The trays 20 are bolted or otherwise secured atop the lower rails 84 by fasteners 90. Each tray 20 is bent or otherwise formed as a trough, having a bottom portion 92 and first and second side portions 94. The side portions 94 project upwardly from either end of the bottom portion 92, giving the tray 20 a broad, U-shaped configuration. The second screening apertures 42 are formed through the bottom portion 92 of each tray 20.

More particularly, the trays 20 are arranged in a spaced overlapping series along the length of and on top of the lower conveyor rails 84. Each tray 20 overlaps the next tray slightly, in reverse tile fashion, starting with the top end 32 of the conveyor bed section 30 and proceeding downwardly therefrom. The lowermost edge of each tray 20 is bolted to the lower rails 84 by the fasteners 90. This fastened lower edge of each tray 20 is then overlapped by the upper edge of the next lower tray 20. A riser plate 96 is secured between the overlapped ends of each pair of adjacent trays 20. The riser plate 96 is oriented perpendicular to the bottom portions 92 of the trays 20. The overlapping, uppermost edge of the bottom portion 92 of each tray 20 is fastened with fasteners 97 to the upper edge of the corresponding riser plate 96. The overlapped, lower edge portion of the adjacent tray 20 is fastened by additional fasteners 97 to the underside of the corresponding riser plate 96. The riser plate 96 is thus sandwiched between overlapping portions of adjacent trays 20. Each riser plate 96 causes the overlapping edge of the overlying tray 20 to be elevated above the lower conveyor rails 84. The bottom portion 92 of each tray 20 thus is oriented at an acute angle relative to a plane defined by the lower conveyor rails 84. The riser plates 96 are oriented at an obtuse angle, and substantially perpendicular, to a plane defined by the lower conveyor rails 84. The riser plates 96 are thus oriented substantially orthogonally to the longitudinal axis of the second conveyer bed section 30.

As best seen in FIG. 5, the tiled, overlapped trays 20 and interspersed riser plates 96 thus cooperatively form the step-contoured upper surface 22 of the second conveyor bed section 30. Each riser plate 96 provides an ascending stop surface which defines a plane having a substantial vertical component. The ascending stop surfaces provided by the riser plates 96 retain particulate matter on the upper surface 22 of the second conveyor bed section 30, and carries the particulate matter forward when the second conveyor bed section 30 is reciprocated forwardly. The bottom portion 92 of each tray 20 forms a ramp surface which angles upwardly from the bottom edge of one riser plate 96 to the upper edge of the next riser plate 96. The ramp surfaces and ascending stop surfaces of the trays 20 and riser plates 96 are oriented transversely to the longitudinal axis of the second conveyor bed section 30.

As illustrated in FIGS. 5 and 6, a plurality of pins 100 are embedded along the upper edge of each riser plate 96, and project forwardly from the riser plate 96 into the interior of the second conveyor bed section 30. The pins 100 act as teeth which aid in carrying and retaining particulate matter on the reciprocating conveyor bed section 30.

The side portions 94 of the tiled trays 20 are secured by fasteners 98 which fasten overlapped segments of the side portions 94 together, as well as by two longitudinal upper conveyor rails 102. The upper conveyor rails 102 are formed from lengths of 90 degree steel angle, and are oriented parallel to and spaced above the lower conveyor rails 84. Each upper conveyor rail 102 is bolted to the upper edges of the side portions 94 of the trays 20 to strengthen the sides of the second conveyor bed section 30. However, it should be readily apparent that other means of reinforcement, such as flat strips of material may be utilized. With the exception of the second screening apertures 42, the conveyor bed sections 16 and 30 form a substantially solid trough.

To minimize the weight of the first and second conveyor bed sections 16 and 30, the trays 20 and riser plates 96 are preferably formed from a lightweight material. One suitable material is a lightweight, corrosion resistant polymer, such as ultra high molecular weight polyethylene. This material has the additional advantage of being flexible and easily formed, allowing the trays 20 to be bolted to the lower rails 84 and then bent upwardly to allow the insertion of the riser plates 96. The entire conveyor bed sections 16 and 30 are extremely light, with the use of metal being limited to the framework provided by lower conveyor rails 84, crossmembers 86, plate 88, and upper conveyor rails 102, as well as connecting hardware. The second conveyor bed section 30 is extremely light and rigid in the longitudinal direction, while each individual tray 20 is flexible.

While the use of polymeric material has been disclosed, it should be apparent that other materials could be employed. For example, the conveyor bed sections 16 and 30 could each be constructed from a unitary, one-piece reinforced thermosetting plastic material, such as glass reinforced polyester resin. The steps could be either integrally formed with the conveyor bed, or wedge segments (not shown) could be fastened periodically to the floor of a flat-bottomed trough to define the steps. Optionally, the trays 20 could be formed from sheets of material other than plastic, such as sheets of aluminum or plywood. However, the use of a lightweight, flexible, corrosion resistance plastic sheet to form the trays 20 has been found preferable.

Attention is now directed to FIGS. 2 and 6 to describe the stationary frame rail assembly 17 which supports the first and second conveyor bed sections 16 and 30. The frame rail assembly 17 includes upper and elongate lower frame rails 104 and 106, which slidaby support the first and second conveyor beds 16 and 30, respectively. The lower frame rails 106 are disposed in spaced parallel disposition on either side of the bottom of the second conveyor bed section 30, as illustrated in FIG. 6. The upper frame rails 104 are similarly disposed below the first conveyor bed 16. The upper frame rails 104 are spaced above, parallel to and overlapping the lower frame rails 106. The longitudinal axes of the upper frame rails 104 and lower frame rails 106 are parallel to the longitudinal axes of the reciprocating first and second conveyor bed sections 16 and 30. The angle of inclination of the upper and lower frame rails 104 and 106 determines the angle of incline of the first and second conveyor bed sections 16 and 30. The upper frame rails 104 and lower frame rails 106 are tied together by vertical side members 108, as shown in FIGS. 2 and 6. The side members 108 are disposed perpendicular to the longitudinal axes of the upper and lower frame rails 104 and 106, spanning from the lower frame rails 106 to the upper frame rails 104, and being secured to the thusly spanned frame rails by welding or other means of attachment. The entire frame rail assembly 17 is securely mounted to the frame base 50.

Referring to FIG. 6, the lower frame rails 106 and upper frame rails 104 are suitably constructed from square cross-sectioned steel tubes. While FIG. 6 illustrates only the mounting of the second conveyor bed section 30 on the lower frame rails 106, it is to be understood that the first conveyor bed section 16 is similarly mounted on the upper frame rails 104. Each lower frame rail 106 defines an upper bearing surface 110 and an inner bearing surface 112. The lower conveyor rails 84 of the second conveyor bed section 30 rest in nesting relationship on top of the corresponding lower frame rails 106 of the frame rail assembly 17. Bearing strips 114 of a low friction material, such as Nylon™ polyamide, are secured by fasteners 116 to the outer surfaces of the lower conveyor rails 84. These bearing strips 114 slide on the upper bearing surfaces 110 and inner bearing surfaces 112 of the lower frame rails 106 during reciprocation on the lower frame rails 106. As the bearing strips 114 wear through use, shims can be added between the bearing strips 114 and the lower conveyor rails 84 to prevent undue lateral or vertical movement of the second conveyor bed section 30 relative to the frame rail assembly 17.

The second conveyor bed section 30 is also provided with anchor brackets 118 made from segments of 90 degree steel angle. A vertical side of each anchor bracket 118 is secured by fasteners 116 to the downwardly depending flange of the lower conveyor rails 84 of the second conveyor bed section 30, while the horizontal side of the anchor brackets 118 extends below the lower frame rails 106 of the frame rail assembly 17. Additional bearing strips 114 are secured by fasteners 116 to the upper surface of the horizontal side of the anchor brackets 118, between the anchor brackets 118 and the lower frame rails 106. The anchor brackets 118 and bearing strips 114 carried thereon prevent the second conveyor bed section 30 from lifting off of or moving vertically relative to the frame rail assembly 17.

While a preferred embodiment of a screening conveyor 10 including first and second reciprocating conveyor bed sections 16 and 30 has been illustrated, it is to be understood that a single conveyor bed section or greater than two conveyor bed sections could be utilized. For example, a single reciprocating conveyor bed section could be utilized which would elevate material upwardly while screening through a single set of screening apertures formed in the bottom of the reciprocating conveyor bed. In lieu of screening apertures provided in the conveyor bed, the conveyor bed could simply be made with a solid stepped floor for conveyance without screening. Further, rather than forming screening apertures in the conveyor bed, a separate screen (not shown) including apertures could be mounted and secured to the top side of the reciprocating bed of the stepped floor of the conveyor bed, with material discharged onto the screen from a feed source and through the reciprocating screen onto the stepped conveying surface. This additional screen could also be used in conjunction with a set of second screening apertures of a different size formed in the conveyor bed floor. Numerous other variations can be made within the scope of the present invention based on the disclosure contained herein.

As a still further example, the screening conveyor 10 illustrated and described includes screening apertures 34 and 42 of predetermined first and second sizes. To provide for adjustment of screening ability of a given screening conveyor 10, adapter plates (not shown) with apertures arranged in the same pattern as the screening apertures 34 and 42, but of smaller dimensions, could be bolted to the upper surface of each tray 20. Further, while the second conveyor bed section 30 has been illustrated as one continuous length, it should be apparent that this conveyor bed section could be made to fold by introducing joints in the upper and lower conveyor rails 84 and 102 to permit shortening of the screening conveyor 10 for transport.

While the preferred embodiment of the invention has been illustrated and described, it will be appreciated that these and various other changes can be made therein without departing from the spirit and scope of the invention. It is therefor intended that the scope of letters patent granted hereon be limited only by the definitions contained in the appended claims.

The embodiments of the invention in which an exclusive property or privilege is claimed are defined as follows:

1. A screening conveyor for conveying particulate matter in a forward direction while screening the particulate matter to separate large particles that are over a predetermined size from small particles that are under a predetermined size, comprising:

a frame;

a conveyor bed supported by the frame and defining a longitudinal axis, an upper discharge end and an upper surface for receiving particulate matter, the upper surface defining a series of transverse steps, each step secured to a common longitudinal support structure for longitudinal reciprocation as an assembly and each step including an ascending surface portion;

reciprocation means coupled between the frame and the conveyor bed for reciprocating the conveyor bed along its longitudinal axis so that the received particulate matter is cared on the ascending surface portions and thrown forwardly from step to step such that the particulate matter is conveyed along the conveyor bed until reaching the upper discharge end where the particulate matter is discharged; and a screen defining a plurality of apertures of predetermined size that is carried on the conveyor bed so that particulate matter is screened through the apertures as it is conveyed on the conveyor bed.

2. The screening conveyor of claim 1, wherein the conveyor bed is inclined to convey particulate matter from a lower elevation to a higher elevation.

3. The screening conveyor of claim 2, wherein the conveyor bed is inclined such that its longitudinal axis defines an angle of less than 34° relative to horizontal.

4. The screening conveyor of claim 1, wherein the screen apertures are defined in a plane oriented parallel to the longitudinal axis of the conveyor bed.

5. The screening conveyor of claim 1, wherein the screen is configured such that the throwing of the particulate matter on the conveyor bed agitates the particulate matter to assist in passage of small particles through the apertures of the screen.

6. The screening conveyor of claim 1, wherein the screen is defined by a plurality of apertures formed in the conveyor bed.

7. The screening conveyor of claim 1, wherein the frame includes first and second longitudinal frame rails spaced in parallel disposition, the conveyor bed being slidably received within and supported by longitudinal frame rails, and the longitudinal frame rails being stationary relative to the reciprocating conveyor bed.

8. The screening conveyor of claim 7, further comprising low friction bearing surfaces provided between the conveyor bed and longitudinal frame rails.

9. The screening conveyor of claim 1, wherein the conveyor bed is constructed from a polymeric plastic material.

10. The screening conveyor of claim 1, wherein the reciprocation means comprises:

a motor having a drive shaft mounted on the frame; and means for coupling the drive shaft of the motor to the conveyor bed and for translating rotary motion of the drive shaft into longitudinal motion of the conveyor bed.

11. The screening conveyor of claim 1, wherein each step is formed from a contoured trough plate having a bottom and first and second opposing sides and a riser plate, the contoured trough plates being tiled in an overlapped series to define the steps with a riser plate being secured between each adjacent pair of overlapping trough plates to create the ascending surface portion of the step defined thereby.

12. The screening conveyor of claim 11, further comprising at least two longitudinal rails secured to the overlapped series of contoured trough plates to interconnect the contoured trough plates.

13. The screening conveyor of claim 1, wherein the ascending surface portion of each step is oriented orthogonally to the longitudinal axis of the conveyor bed.

14. The screening conveyor of claim 13, wherein the ascending surface portion of each step includes an upper edge and a lower edge, each given step further including a ramp surface portion that extends from the lower edge of the ascending surface portion of a preceding step to the upper edge of the ascending surface portion of said given step.

15. The screening conveyor of claim 1, wherein each ascending surface portion defines an upper and lower edge, and the upper surface of the conveyor bed further defines a series of ramp surface portions interposed between the series of ascending surface portions, each ramp surface portion ascending from the bottom edge of a preceding ascending surface portion to the top edge of the next ascending surface portion.

16. The screening conveyor of claim 1, wherein the conveyor bed comprises first and second conveyor bed sections supported above the frame in overlapped parallel disposition, each of the first and second conveyor bed sections having a feed end and a discharge end, the discharge end of the first conveyor bed section overlapping the feed end of the second conveyor bed section, each of the first and second conveyor bed sections reciprocating along a corresponding longitudinal axis.

17. The screening conveyor of claim 16, wherein the screen comprises first and second screens carried on the first and second conveyor bed sections, the first screen including a plurality of apertures of a first predetermined size and the second screen including a plurality of apertures of a second, smaller predetermined size.

18. The screening conveyor of claim 17, further comprising an auxiliary conveyor for receiving materials that are over the first predetermined size from the discharge end of the first conveyor section.

19. The screening conveyor of claim 17, wherein the first and second screens comprise a plurality of first apertures defined in the first conveyor bed section and a plurality of second apertures defined in the second conveyor bed section.

20. The screening conveyor of claim 19, further comprising an auxiliary conveyor mounted on the frame and disposed adjacent the discharge end of the first conveyor section, the auxiliary conveyor receiving particulate matter that is larger than the first predetermined size from the discharge end of the first conveyor section, particulate matter that is smaller than the first predetermined size falling through the first apertures of the first conveyor section onto the feed end of the second conveyor section.

21. The screening conveyor of claim 16, wherein the first and second conveyor sections reciprocate in balanced opposition.

22. The screening conveyor of claim 21, wherein the reciprocation means comprises a motor mounted on the frame having a rotary drive shaft, first and second eccentric cams coupled to the rotary drive shaft, and first and second connecting rods each having a first end journaled to a corresponding one of the first and second eccentric cams and a second end journaled to a corresponding one of the first and second conveyor bed sections.

23. The screening conveyor of claim 1, further comprising a plurality of teeth projecting forwardly from each ascending surface portion of the conveyor bed to aid in carrying forward the particulate matter.

24. A screening conveyor for conveying particulate matter in a forward direction while screening the particulate matter to separate large particles that are over a predetermined size from small particles that are under a predetermined size, comprising:

a frame;

a conveyor bed supported by the frame and defining a longitudinal axis and an upper surface for receiving particulate matter, the upper surface defining a series of steps each step including an ascending surface portion;

reciprocation means coupled between the frame and the conveyor bed for reciprocating the conveyor bed along its longitudinal axis so that the received particulate matter is carried on the ascending surface portions and thrown forwardly from step to step, wherein the reciprocation means comprises:

a motor having a drive shaft mounted on the frame; and means for coupling the drive shaft of the motor to the conveyor bed and for translating rotary motion of the drive shaft into longitudinal motion of the conveyor bed, wherein the means for coupling and translating comprises a cam plate coupled to the drive shaft and a connecting rod having a first end eccentrically journaled to the cam plate and a second end journaled to the conveyor bed; and a screen defining a plurality of apertures of predetermined size that is carried on the conveyor bed so that particulate matter is screened through the apertures as it is conveyed on the conveyor bed.

25. A conveyor for conveying particulate matter from a lower elevation to a higher elevation, comprising:

a frame;

an inclined conveyor bed supported above the frame and defining a longitudinal axis, an upper discharge end and an upper surface for receiving particulate matter, the upper surface defining a plurality of transverse stops for retaining the particulate matter on the incline, each stop secured to a common longitudinal support structure for longitudinal reciprocation as an assembly;

a motor mounted on the frame; and a linkage coupled between the motor and the conveyor bed for translating rotary motion from the motor into longitudinal reciprocation on the conveyor bed, so that the particulate matter is carried on the stops and throb forwardly up the inclined conveyor bed from stop to stop such that the particulate matter is conveyed upwardly along the conveyor bed until reaching the upper discharge end where the particulate matter is discharged.

26. A conveyor bed for conveying particulate matter in a forwardly direction, comprising:

an elongate conveyor bed frame;

a plurality of trays securable to the conveyor bed frame to define an elongate trough having a bottom wall and fast and second opposing sidewalls, each tray defining a transverse step formed in the bottom wall of the trough, each step secured to the elongate conveyor bed frame and the first and second opposing sidewalls for longitudinal reciprocation as an assembly and each step having an ascending stop surface for carrying particulate matter forwardly from step to step.

27. A conveyor for conveying particulate matter in a forward direction, comprising:

a conveyor bed defining a longitudinal axis, an upper discharge end and an upper surface for receiving particulate matter, the upper surface defining a series of transverse steps, each step secured to a common longitudinal support structure for longitudinal reciprocation as an assembly and each step including an ascending surface portion; and reciprocation means for reciprocating the conveyor bed along its longitudinal axis, so that the particulate matter is carried on the ascending surface portions and thrown forwardly from step to step such that the particulate matter is conveyed forwardly along the conveyor bed until reaching the upper discharge end where the particulate matter is discharged.

28. The conveyor of claim 27, wherein the conveyor bed is inclined to convey particulate matter from a lower elevation to a higher elevation.

29. The conveyor of claim 28, wherein the conveyor bed is inclined such that its longitudinal axis defines an angle of less than 34° relative to horizontal.

30. The conveyor of claim 27, further comprising a frame including first and second longitudinal frame rails spaced in parallel disposition, the conveyor bed being slidably received within and supported by the longitudinal frame rails, and the longitudinal frame rails being stationary relative to the reciprocating conveyor bed.

31. The conveyor of claim 27, wherein the reciprocation means comprises:

a motor having a drive shaft; and means for coupling the drive shaft of the motor to the conveyor bed and for translating rotary motion of the drive shaft into longitudinal motion of the conveyor bed.

32. The conveyor of claim 31, wherein the means for transmitting and translating comprises a cam plate coupled to the drive shaft and a connecting rod having a first end eccentrically journaled to the cam plate and a second end journaled to the conveyor bed.

33. The conveyor of claim 27, wherein the steps of the upper surface of the conveyor bed are oriented transverse to the longitudinal axis of the conveyor bed.

34. The conveyor of claim 33, wherein the ascending surface portion of each step is oriented orthogonally to the longitudinal axis of the conveyor bed.

35. The conveyor of claim 34, wherein the ascending surface portion of each step includes an upper edge and a lower edge, each given step further including a ramp surface portion that extends from the lower edge of the ascending surface portion of a preceding step to the upper edge of the ascending surface portion of said given step.

36. The conveyor of claim 33, wherein each ascending surface portion defines an upper and lower edge, and the upper surface of the conveyor bed further defines a series of ramp surface portions interposed between the series of ascending surface portions, each ramp surface portion ascending from the bottom edge of a preceding ascending surface portion to the top edge of the next ascending surface portion.

37. The conveyor of claim 27, wherein each step is formed from a contoured trough plate having a bottom and first and second opposing sides and a riser plate, the contoured trough plates of each step being tiled in an overlapping series to define the steps with a riser plate being secured between each adjacent pair of overlapping trough plates to create the ascending surface portion of the step defined thereby.

38. The conveyor of claim 37, further comprising at least two longitudinal rails secured to the overlapped series of contoured trough plates to interconnect the contoured trough plates.

39. The conveyor of claim 27, further comprising a plurality of teeth projecting forwardly from each ascending surface portion of the conveyor bed to aid in carrying forward the particulate matter.

40. A method for conveying particulate matter in a forward direction, comprising:

feeding the particulate matter onto a lower end of an upper surface of a conveyor bed supported by a frame, the upper surface of the conveyor bed defining a series of transverse steps, each step secured to a common longitudinal support structure for longitudinal reciprocation as an assembly and each step including an ascending surface portion; and reciprocating the conveyor bed relative to the frame along a longitudinal axis of the conveyor bed so that the received particulate matter is carried on the ascending surface portions and thrown forwardly from step to step such that the particulate matter is conveyed along the conveyor bed and discharged an upper discharge end of the conveyor bed.

41. The method of claim 40, further comprising screening the particulate matter during reciprocation through a plurality of first apertures of a first predetermined size defined in a screen carried on the conveyor bed.

42. The method of claim 41, further comprising feeding particulate matter screened through the first apertures onto a second conveyor bed.

43. The conveyor of claim 42, further comprising screening the particulate matter fed onto the second conveyor bed through a plurality of second screening apertures of a second predetermined size defined in a screen carried on the second conveyor bed.

44. The method of claim 43, wherein the feeding of screened particulate matter onto said second conveyor bed comprises:

feeding the screened particulate matter onto an elongate second conveyor bed having a stepped upper surface; and reciprocating the second conveyor bed longitudinally so that particulate matter is thrown forwardly from step to step.

* * * * *